US010976030B1

(12) United States Patent
Henkel

(10) Patent No.: US 10,976,030 B1
(45) Date of Patent: Apr. 13, 2021

(54) PORTABLE BEACH VOLLEYBALL LIGHTING SYSTEM

(71) Applicant: Francis J. Henkel, Long Beach, NY (US)

(72) Inventor: Francis J. Henkel, Long Beach, NY (US)

( * ) Notice: Subject to any disclaimer, the term of this patent is extended or adjusted under 35 U.S.C. 154(b) by 0 days.

(21) Appl. No.: 16/797,596

(22) Filed: Feb. 21, 2020

(51) Int. Cl.

| | |
|---|---|
| ***F21V 14/08*** | (2006.01) |
| ***F21S 8/08*** | (2006.01) |
| ***F21S 9/02*** | (2006.01) |
| ***F21V 11/18*** | (2006.01) |
| ***F21V 21/08*** | (2006.01) |
| ***F21V 21/14*** | (2006.01) |
| ***A63C 19/00*** | (2006.01) |
| ***F21V 21/088*** | (2006.01) |

(52) U.S. Cl.
CPC ..... *F21V 14/08* (2013.01); *A63C 19/00* (2013.01); *F21S 8/086* (2013.01); *F21S 9/02* (2013.01); *F21V 11/18* (2013.01); *F21V 21/088* (2013.01); *F21V 21/0824* (2013.01); *F21V 21/14* (2013.01); *A63C 2203/14* (2013.01)

(58) Field of Classification Search
CPC ..... F21V 14/08; A63C 2203/14; F21S 8/086
See application file for complete search history.

(56) References Cited

U.S. PATENT DOCUMENTS 5,417,438 A 5/1995 Poff
5,436,811 A * 7/1995 Hecking ..... A01G 25/00 239/279
5,653,640 A 8/1997 Shirley, Jr.
5,916,048 A 6/1999 Hurell et al.
6,561,678 B2 5/2003 Loughrey
6,575,853 B1 6/2003 O'Neill et al.
6,866,589 B1 * 3/2005 Widrick ..... A63C 19/10 472/90
7,182,480 B2 2/2007 Kan
8,297,792 B1 * 10/2012 Wang ..... F21S 8/086 362/249.03
8,690,715 B2 4/2014 Vogt
(Continued)

FOREIGN PATENT DOCUMENTS

CN 104501049 A 4/2015
EP 0030740 A2 6/1981

*Primary Examiner* — Jong-Suk (James) Lee
*Assistant Examiner* — Christopher E Dunay
(74) *Attorney, Agent, or Firm* — Mandelbaum Silfin Economou LLP; John S. Economou

(57) ABSTRACT

A system for lighting a volleyball court has four corner light assemblies, two side center light assemblies, and four mid-court light assemblies. Each corner light assembly has an upper light fixture adapted to emit light outward and downward at a level generally below a player's eye level and a lower light element mounted in a manner to emit light outwards and upwards. Each side center light assembly has two lower light fixtures adapted to emit light outward and downward at a level generally below a player's eye level and an upper light assembly adapted to emit light outwards and upwards at a level generally above a player's eye level. Each mid-court light assembly has a light fixture adapted to emit light outward and downward at a level generally below a player's eye level. By ensuring that no light is emitted at a player's eye level, glare is significantly reduced.

13 Claims, 19 Drawing Sheets

(56) References Cited

U.S. PATENT DOCUMENTS

| | | | | |
|---|---|---|---|---|
| 8,998,649 | B2 | 4/2015 | Lemons et al. | |
| 9,115,867 | B2 | 8/2015 | Gregoris | |
| 10,337,680 | B1 * | 7/2019 | Gordin | F21V 21/116 |
| 2004/0124582 | A1 | 7/2004 | Oister et al. | |
| 2009/0129081 | A1 * | 5/2009 | Gordin | F21S 2/00 362/235 |
| 2010/0110673 | A1 | 5/2010 | Bergman et al. | |
| 2014/0171234 | A1 * | 6/2014 | Vogt | A63C 19/06 473/490 |
| 2014/0340889 | A1 * | 11/2014 | Gordin | F21V 7/04 362/231 |
| 2015/0113842 | A1 | 4/2015 | Suhr | |
| 2015/0334807 | A1 * | 11/2015 | Gordin | F21V 23/0464 315/152 |
| 2017/0102117 | A1 * | 4/2017 | Cordova | F21S 8/085 |

* cited by examiner

PORTABLE BEACH VOLLEYBALL LIGHTING SYSTEM

FIELD

This disclosure relates generally to an outdoor sports lighting system and more specifically it relates to a portable volleyball lighting system for use outdoors on a beach or other venue.

BACKGROUND

Volleyball is unique among sports in that most of action occurs in the air, above the head of every player. In an indoor venue or during the day, it is not difficult to keep track of the flight of the ball as it moves in the air between each side of the net as players on each team take turns in striking the ball. However, volleyball, and beach volleyball in particular, is often played outside at night under artificial lighting. Conventional artificial lighting systems for outdoor sports consist of a number light assemblies positioned high above the playing surface on poles mounted around the court, with each of the light assemblies aimed to emit light down at the playing surface. These systems have a number of drawbacks when used for outdoor beach volleyball. First and foremost, a volleyball player will often lose track of the flight of the ball due to glare from one or more of the light assemblies shining in their eyes. In addition, volleyball players can also lose track of the flight of the ball when the ball moves into darkness above the height of the pole-mounted light assemblies. Further, shadows cast by the ball as it moves in the air between each side of the net can be distracting to the volleyball players.

Beach volleyball has become quite popular world-wide, and courts can be set up quickly on any available open beach area using portable net systems. However, there are presently no available portable lighting systems for beach volleyball, so that nighttime beach volleyball is presently limited to dedicated courts having permanent lighting installations.

Accordingly, there is a need for improved lighting systems for outdoor beach volleyball that overcomes the problems recited above.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure.

The present disclosure is addressed to various embodiments of a volleyball lighting system that provide distributed aerial lighting above and on the volleyball court in order to keep the volleyball itself and the volleyball court boundaries illuminated at all times. Three different types of light assemblies are disclosed, with each lighting element preferably including a glare protector to eliminate glare and to reduce shadows on the volleyball court surface, including a first (corner) light assembly, a second (side center) light assembly, and a third (mid-court) light assembly which are arranged around the perimeter of the volleyball court to provide lighting thereto, each with light emitting elements arranged to emit light in a pattern generally above the eye level of the tallest player on the volleyball court and/or light emitting elements arranged to emit light in a pattern generally below the average eye level of the shortest volleyball player on the court.

Figure 1A:
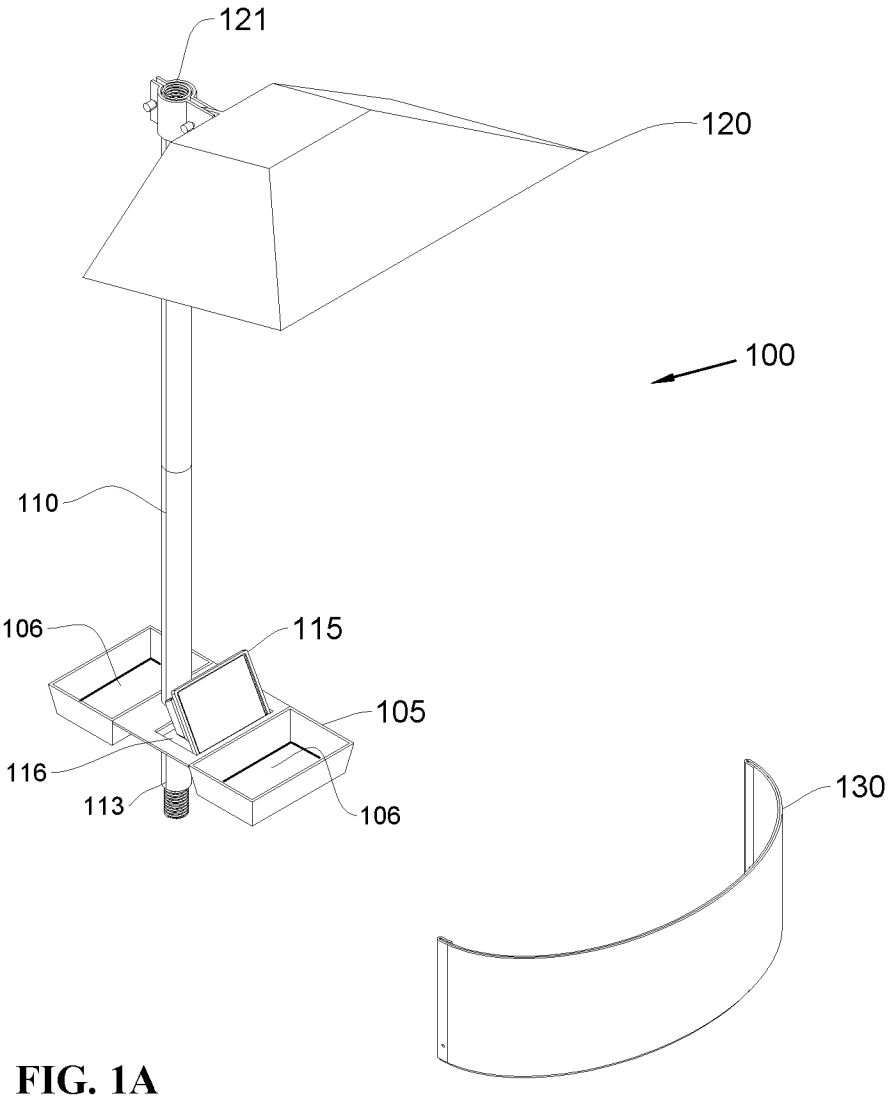
FIG. 1A is a top front side view of a corner light assembly according to the present disclosure.
Figure 1B:
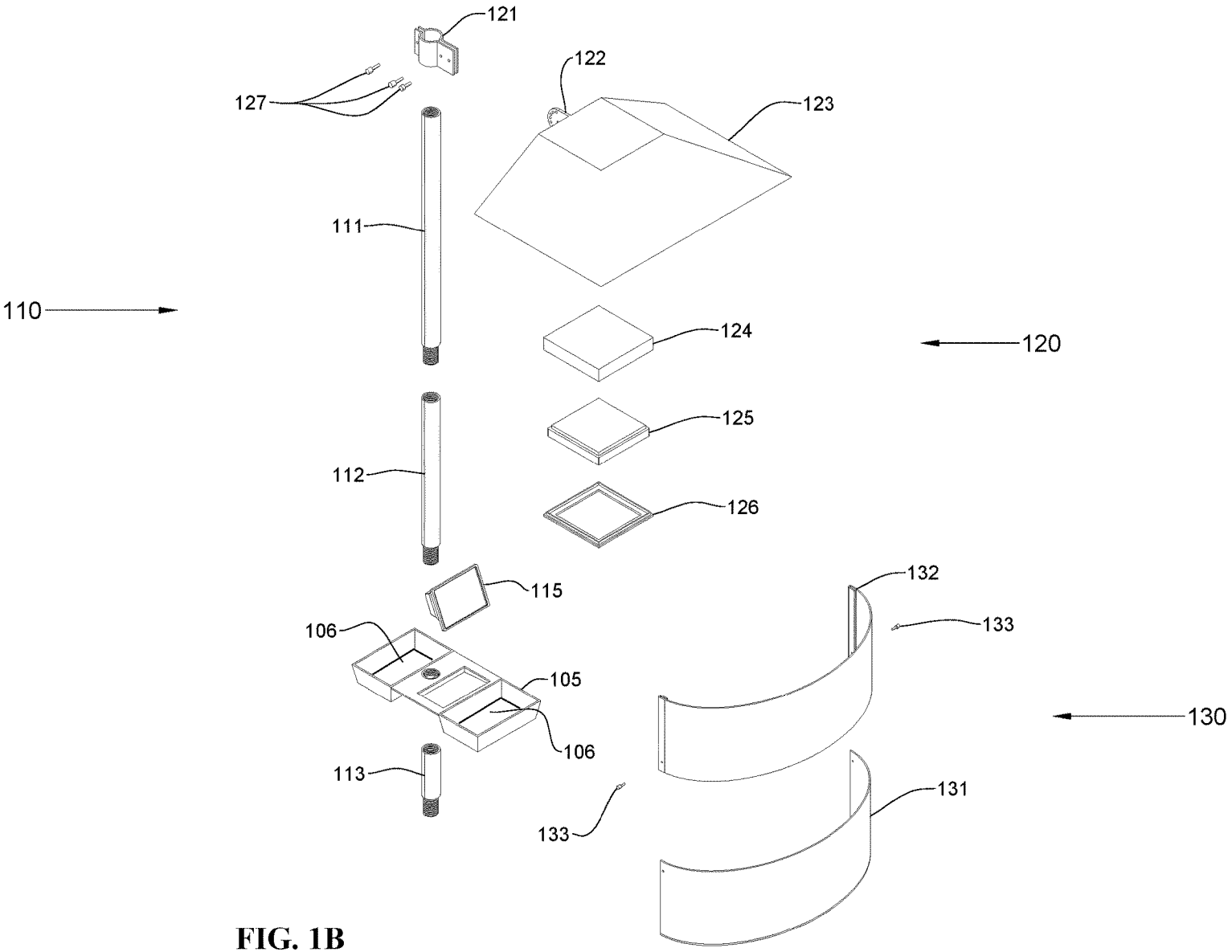
FIG. 1B is an exploded top front side view of the corner light assembly.

Referring now to FIGS. 1A and 1B, each corner light assembly 100 includes a base portion 105, a vertical support pole 110 fixedly mounted to base portion 105 via threads in a lower portion thereof that mate with a threaded aperture in base portion 105, a lower light emitting element 115 mounted in a slot 116 on base portion 105, and an upper light fixture 120. Lower light emitting element 115 includes an integral high output light emitting element which is preferably battery-powered, but alternatively may be powered via a power cord that connects conventionally to an available electrical outlet (or portable power supply/generator). Vertical support pole 110 is preferably formed from two portions 111 and 112 which thread together in a conventional manner. A below ground member 113 is optionally coupled to a lower surface of base portion 105 (e.g., by threads that mate with threads on a bottom portion of vertical support pole 110 that pass through base portion 105) in order to better secure base portion 105 when corner light assembly 100 is mounted in sand as is normally present at a beach. Base portion 105 preferably includes front and back cavities 106 that may be filled with sand or other material in order to better secure corner light assembly 100 to the ground during use. In a first embodiment, a corner light assembly 100 is placed outside of each corner of the volleyball court, as shown in FIGS. 4 and 5. Upper light fixture 120 is shown in more detail in FIG. 1B, and includes a hood 123, a clamp mechanism 121 for connection to the top of the vertical support 110 via mating hardware 127 (e.g., nuts and bolts), an adjustment mechanism 122 mounted on hood 123 which provides an adjustable coupling to clamp mechanism 121, and a light emitting element 125 mounted to an inner surface of the hood 123 via a casing 124 and a flange 126. Light emitting element 125 is also an integral high output light emitting element which is preferably battery-powered, but alternatively may be powered via a power cord that connects conventionally to an available electrical outlet.

Figure 2:
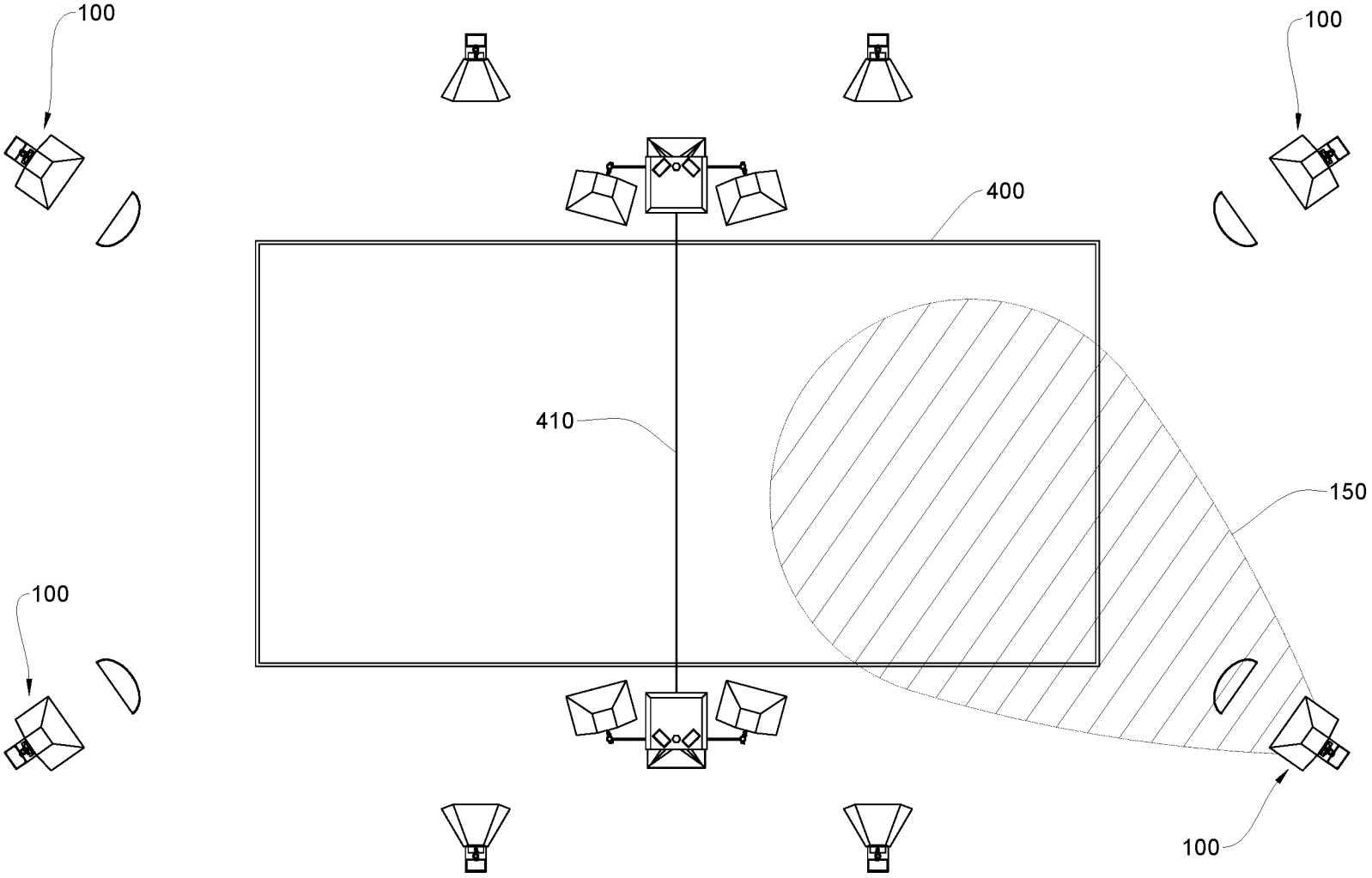
FIG. 2 is a top view of a volleyball court showing the light pattern dispersed from one of the light emitting elements on the corner light assembly.
Figure 3A:
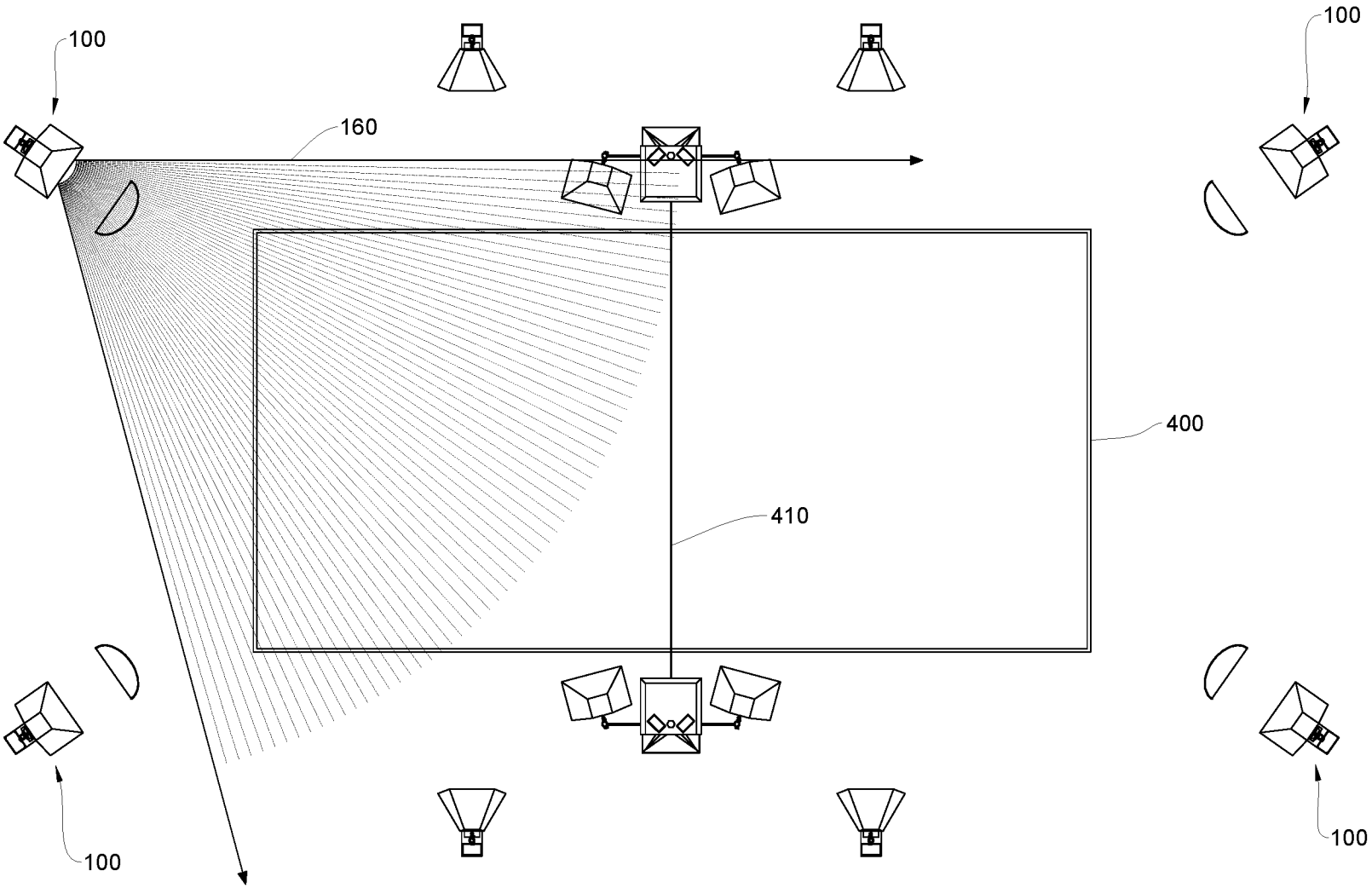
FIG. 3A is a top view of a volleyball court and FIG. 3B is a side view of the volleyball court, each of FIG. 3A and FIG. 3B showing the light pattern dispersed from another of the light emitting elements on the corner light assembly.
Figure 3B:
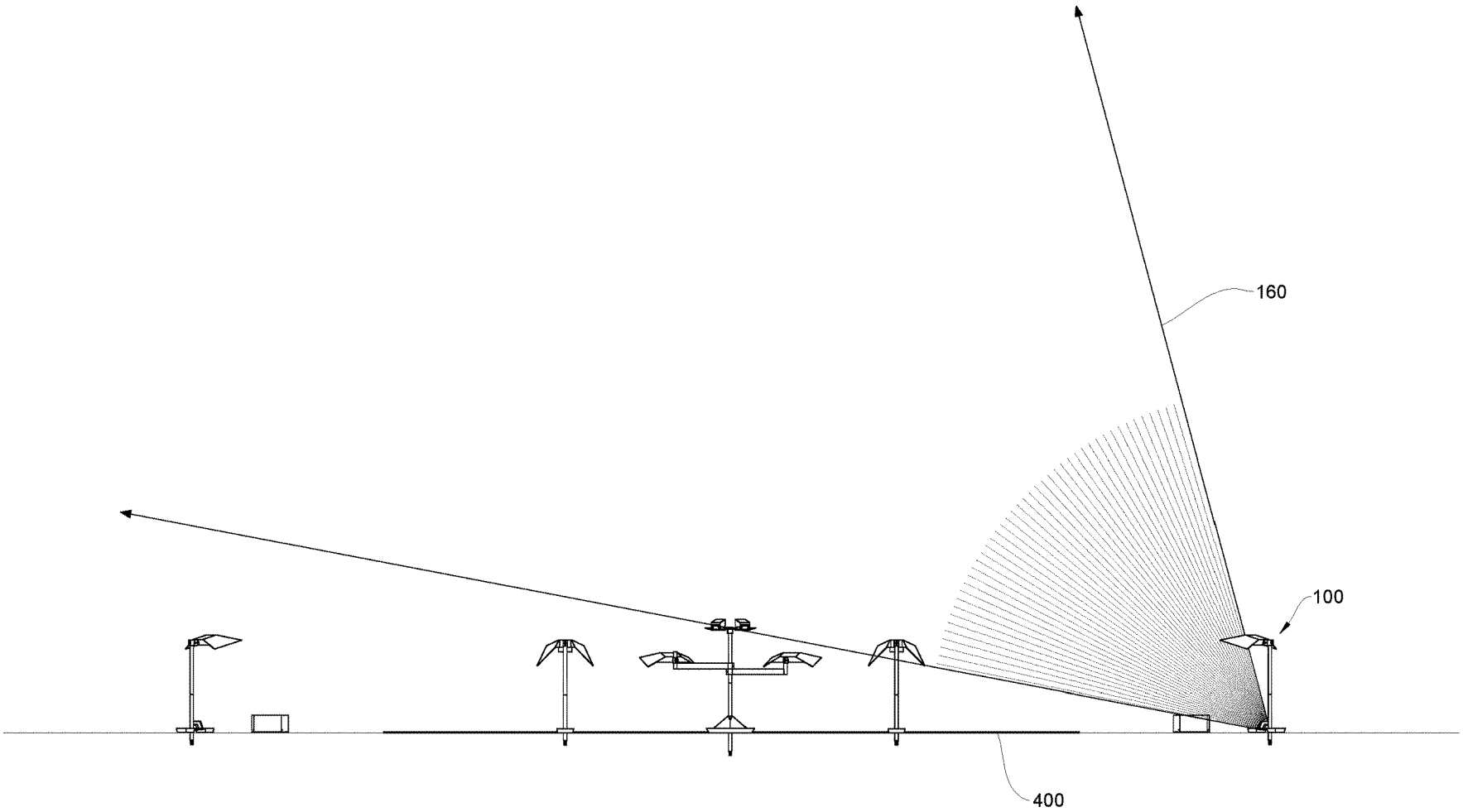

The adjustment mechanism 122 allows the hood 123 to rotate up and down in order to adjust how light emitted by light emitting element 125 is dispersed onto the volleyball court. In use, once a corner light assembly 100 is positioned at a corner of the volleyball court, the adjustment mechanism 122 on the upper light fixture 120 of that corner light assembly 100 is adjusted to so that light is emitted in a manner which illuminates the rear to mid portion of that corner of the volleyball court, and at a level generally below the eye level of the volleyball players in order to eliminate glare. The light path 150 for the light emitting element 125 is shown in FIG. 2. Lower light emitting element 115 emits light generally upwards and outward in order to light the lower side of a volleyball in flight. The light path 160 for the lower light emitting element 115 is shown in FIGS. 3A and 3B.

A separate glare protector 130 may be provided which includes a horizontal base portion (not shown), a lower fixed vertical curved portion 131, and an upper adjustable vertical curved portion 132. The upper adjustable vertical curved portion 132 may be moved up and down (and secured in place by screws 133 once a final position is found) to ensure that the light emitted by lower light emitting element 115 does not cause glare in the eyes of the volleyball players. Likewise, glare protector 130 may be moved closer or further from corner light assembly 5 in order to control the dispersal of light and to ensure that no light is emitted at a player's eye level. Alternatively, a glare protector providing the same functionality as glare protector 130 may be integrated directly onto base 105.

When corner light assemblies 100 are positioned at each corner of a beach volleyball court, the upper light fixtures 120 will emit light generally horizontally and below horizontal, allowing the players to see their position on the volleyball court in relation to other players, the net, and the volleyball court boundaries, without ever being subjected to glare from the upper light fixtures. In addition, the lower light fixtures 115 will emit light upwards and outward—illuminating a lower portion of the volleyball in flight, with the light generally above the eye level of the players and eliminating glare from lower light fixtures 115 when each glare protector 130 is positioned properly. In some cases, the use of four corner assemblies 100 alone will provide acceptable lighting for a night-time beach volleyball game. This embodiment can be useful for practice, novice players, or informal non-competitive games, for example.

Figure 4A:
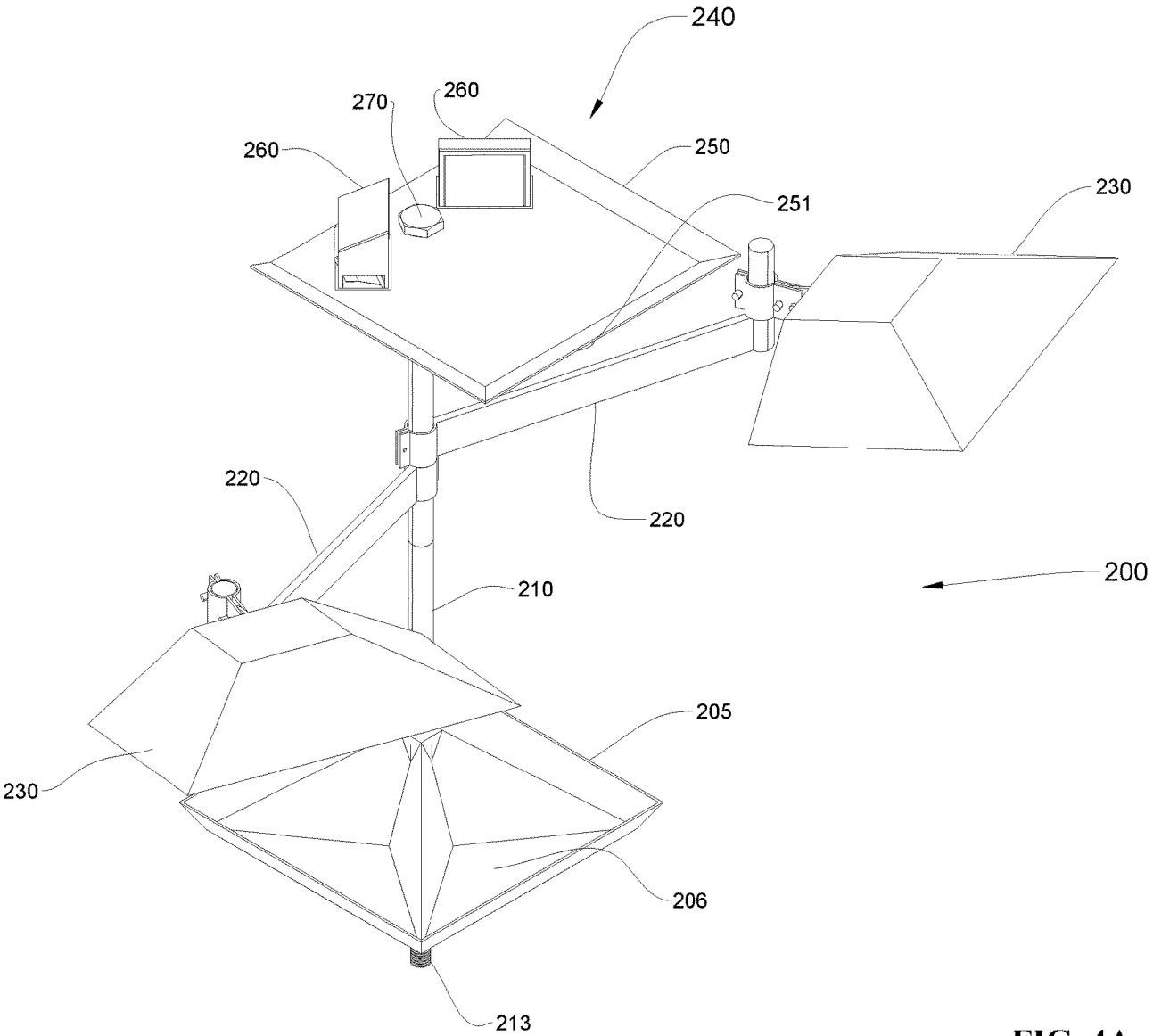
FIG. 4A is a top front side view of a side center light assembly according to the present disclosure.
Figure 4B:
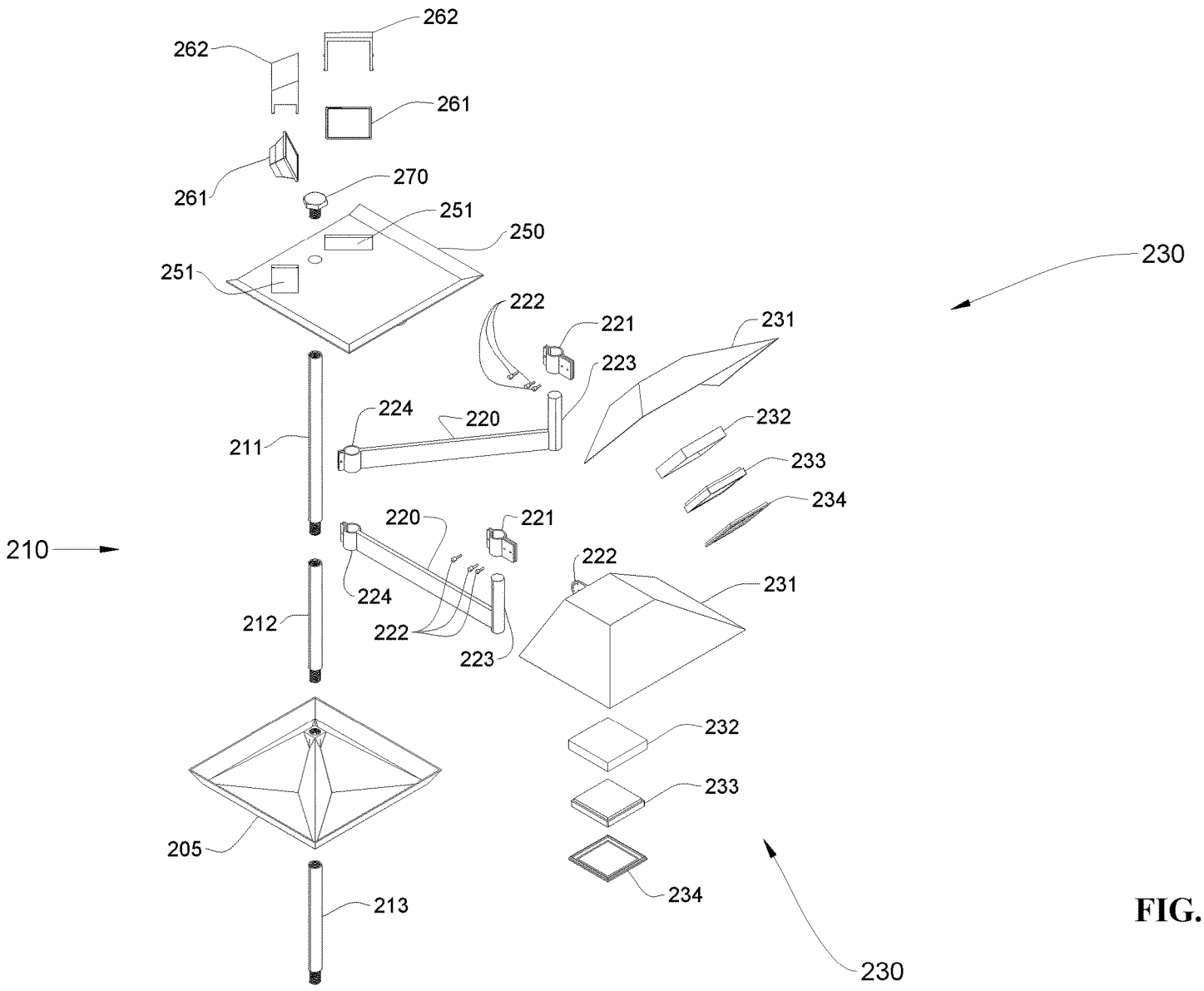
FIG. 4B is an exploded top front side view of the side center light assembly.
Figure 5:
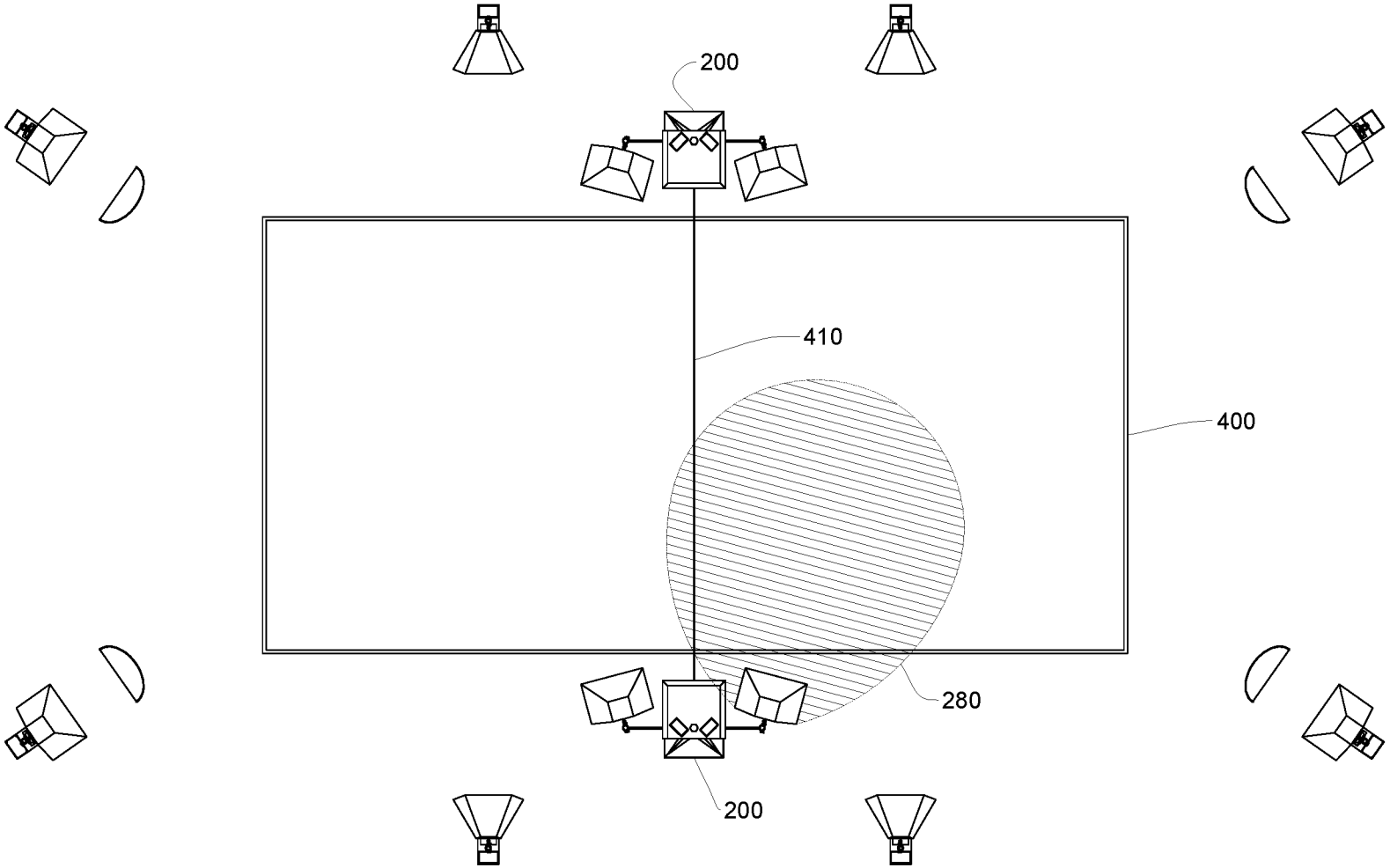
FIG. 5 is a top view of a volleyball court showing the light pattern dispersed from one of the light emitting elements on the side center light assembly.

In a second embodiment, two side center light assemblies 200 may be provided in a position directly adjacent to a respective one of the two support poles holding up the volleyball net (as shown in FIGS. 4 and 5). Each side center light assembly 200, as shown in FIGS. 4A and 4B, includes a base portion 205, a vertical support pole 210 fixedly mounted to base portion 205 via threads in a lower portion thereof which mate with a threaded aperture in base portion 205, two separate bracket arm assemblies 220 affixed to vertical support pole 210 via a clamping element 224 at a first end thereof, two separate lower light fixtures 230 affixed to vertical support pole 210 via a respective one of the bracket arm assemblies 220 (as discussed below), and an upper light assembly 240. In an alternative embodiment, the vertical support pole 210 of each center light assembly 200 may also hold up the volleyball net, eliminating the need for a separate support pole on each side of the net. In this alternative embodiment, the base portion 205 may be eliminated when the volleyball net support lines provide adequate stability for each vertical support pole 210. Base portion 205 preferably includes four cavities 206 on each side that may be filled with sand or other material in order to better secure side center light assembly 200 to the ground during use. A below ground member 213 is optionally coupled to a lower surface of base portion 205 (e.g., by threads that mate with threads on a bottom portion of vertical support pole 210 that pass through base portion 205), also used to better secure base portion 205 when corner light assembly 200 is mounted in sand as is normally present at a beach.

Upper light assembly 240 consists of an upper platform 250 which is coupled to vertical support pole 210 via a connecting mechanism 270 (e.g., a bolt that threads into internal threads at the top of vertical support pole 210), and two separate upper light modules 260. The upper platform 250 may include a downward facing slot 251 (partially shown in FIG. 4A) (e.g., a cylindrical slot) that slides over the top portion of the adjacent volleyball net pole for added support of side center assembly 200. Each light module 260 consists of a light fixture 261 and a bracket 262 for securing light fixture 261 into a slot 251 on upper platform 250. Each light fixture 261 includes an integral high output light emitting element which is preferably battery-powered, but alternatively may be powered via a power cord that connects conventionally to an available electrical outlet. Each light module 260 is positioned at the rear of platform 250 to project light outwardly and upwardly, and only above a horizontal line parallel to the surface of upper platform 250 (upper platform 250 prevents any light from the light modules 260 from being projected below the height of platform 250) in order to ensure that such light does not shine or otherwise glare into the eyes of players on the volleyball court.

Each light assembly 230 is shown in more detail in FIG. 1B, and includes a hood 231, a clamp mechanism 221 for connection to a projecting member 223 at a second end of an associated one of the bracket arm assemblies 220 (opposite to the first end) via mating hardware 222 (e.g., nuts and bolts), an adjustment mechanism 222 mounted on hood 231 which provides an adjustable coupling to clamp mechanism 221, and a light emitting element 233 mounted to an inner surface of the hood 231 via a casing 232 and a flange 234. Light emitting element 233 is also an integral high output light emitting element which is preferably battery-powered, but alternatively may be powered via a power cord that connects conventionally to an available electrical outlet.

Figure 6A:
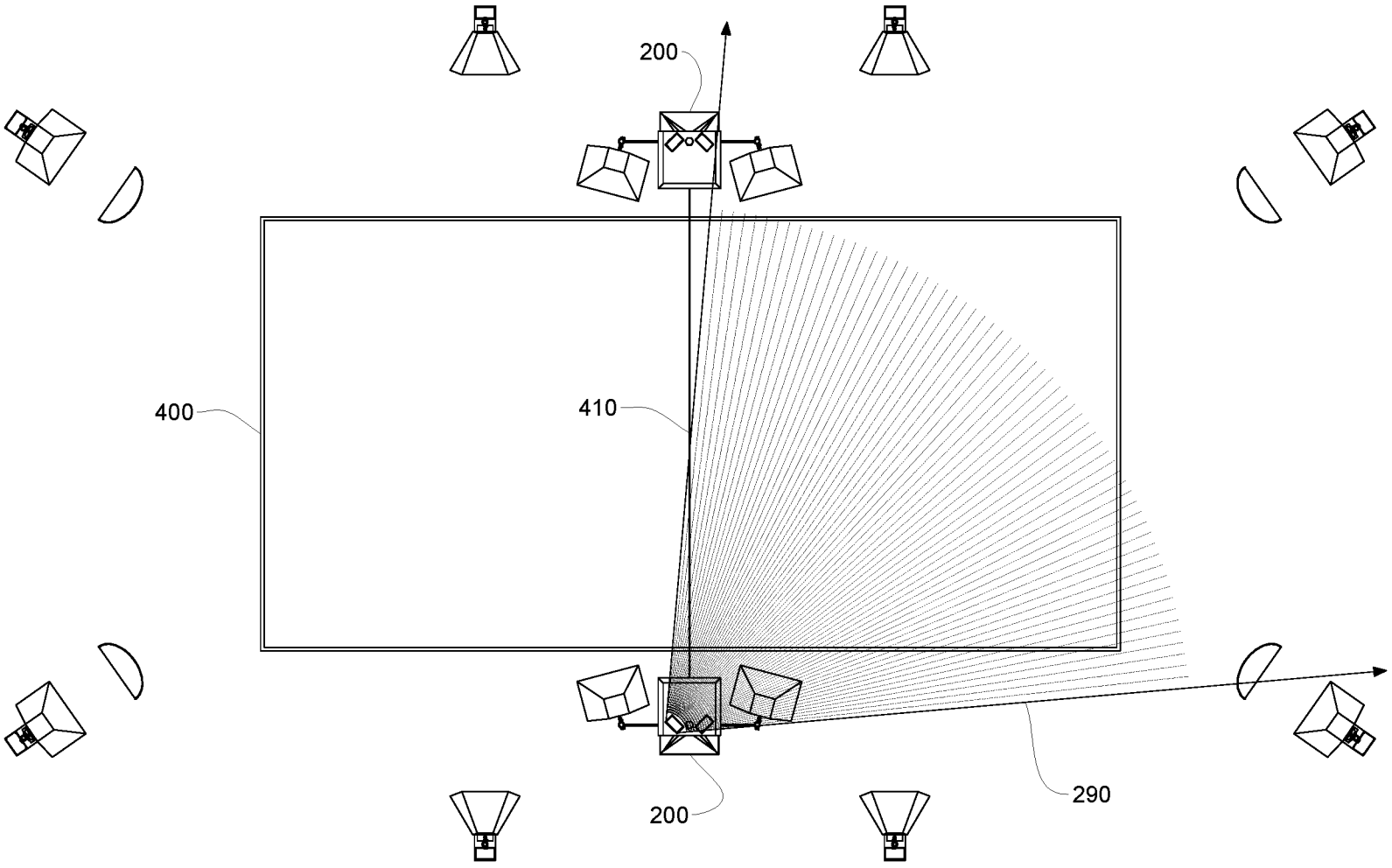
FIG. 6A is a top view of a volleyball court and FIG. 6B is a side view of the volleyball court, each of FIG. 6A and FIG. 6B showing the light pattern dispersed from another of the light emitting elements on the side center light assembly.
Figure 6B:
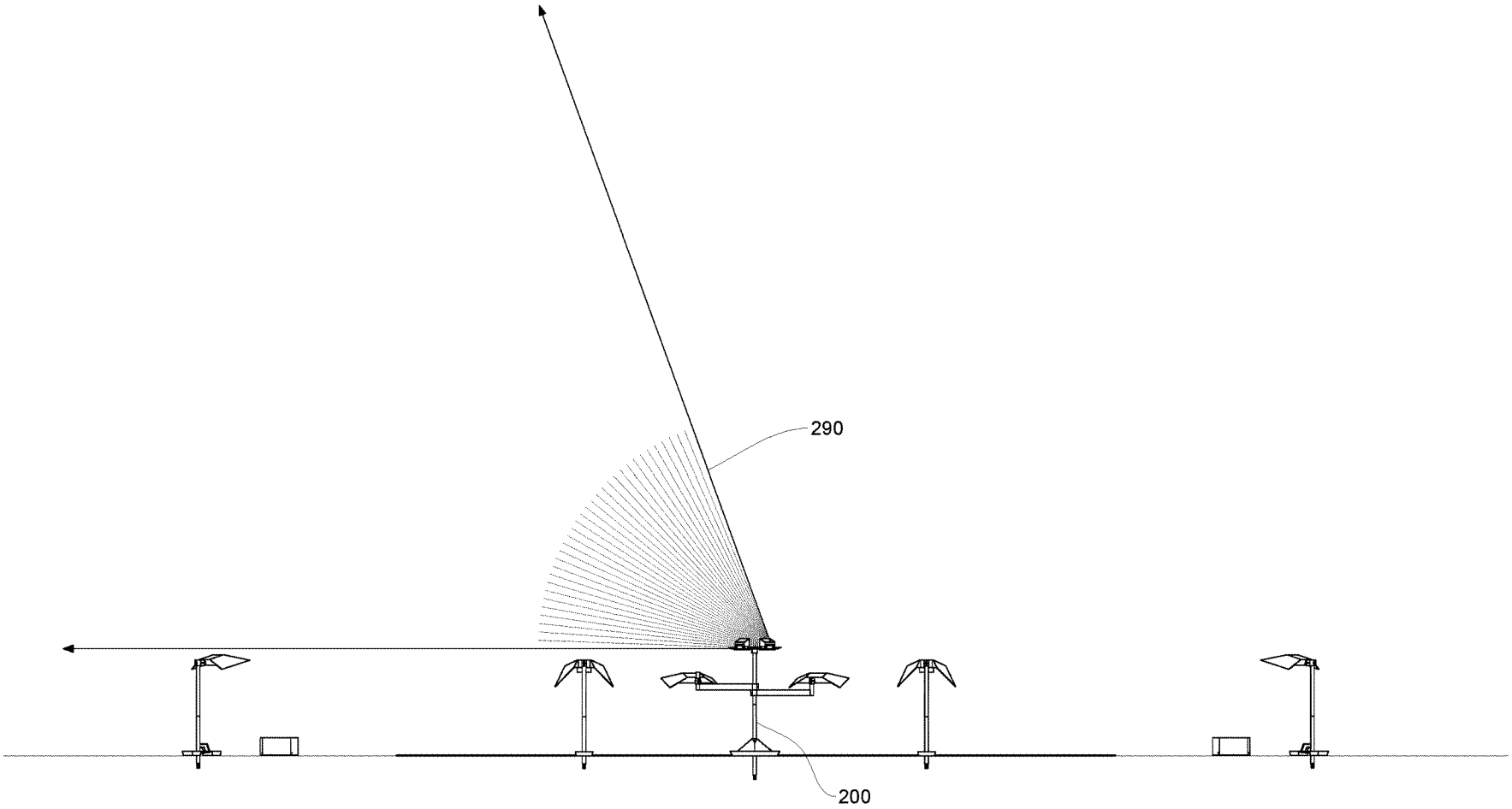

The adjustment mechanism 222 allows the hood 231 to rotate up and down in order to adjust how light emitted by light emitting element 233 is dispersed onto the volleyball court. In use, once a side center light assembly 200 is positioned at adjacent to one of the poles holding up the net at the center of the volleyball court, the adjustment mechanism 222 on each lower light fixture 230 of that side center light assembly 100 is adjusted to so that light is emitted in a manner which illuminates the center to mid portion of the associated side of the volleyball court, and at a level generally below the eye level of the volleyball players in order to eliminate glare. The light path 280 for one of the light emitting elements 233 is shown in FIG. 5. The two upper light modules 260 each emits light generally upwards and outward in order to light the lower side of a volleyball in flight, particularly in the area adjacent to the associated side and center portion of the volleyball court. As explained above, by placing the two upper light modules 260 at the rear of upper platform 250, none of the light emitted by such modules will shine or otherwise glare into the eyes of the volleyball players, because upper platform, positioned above the height of the players, will act as a shield to block any light from such modules from projecting downward below the height of upper platform 250. The light path 290 for one of the light emitting elements 260 is shown in FIGS. 6A and 6B.

By adding a side light center assembly 200 on each side of a volleyball court (directly adjacent to each volleyball net pole, as shown in FIGS. 4 and 5), to the four corner light assemblies 100 in each corner of the volleyball court, additional lighting will be provided generally above and below the eye level of a player in the area adjacent to the net. This combination provides an enhanced experience in playing volleyball on a beach, as may be required by more competitive players and mid-level competition.

Figure 7A:
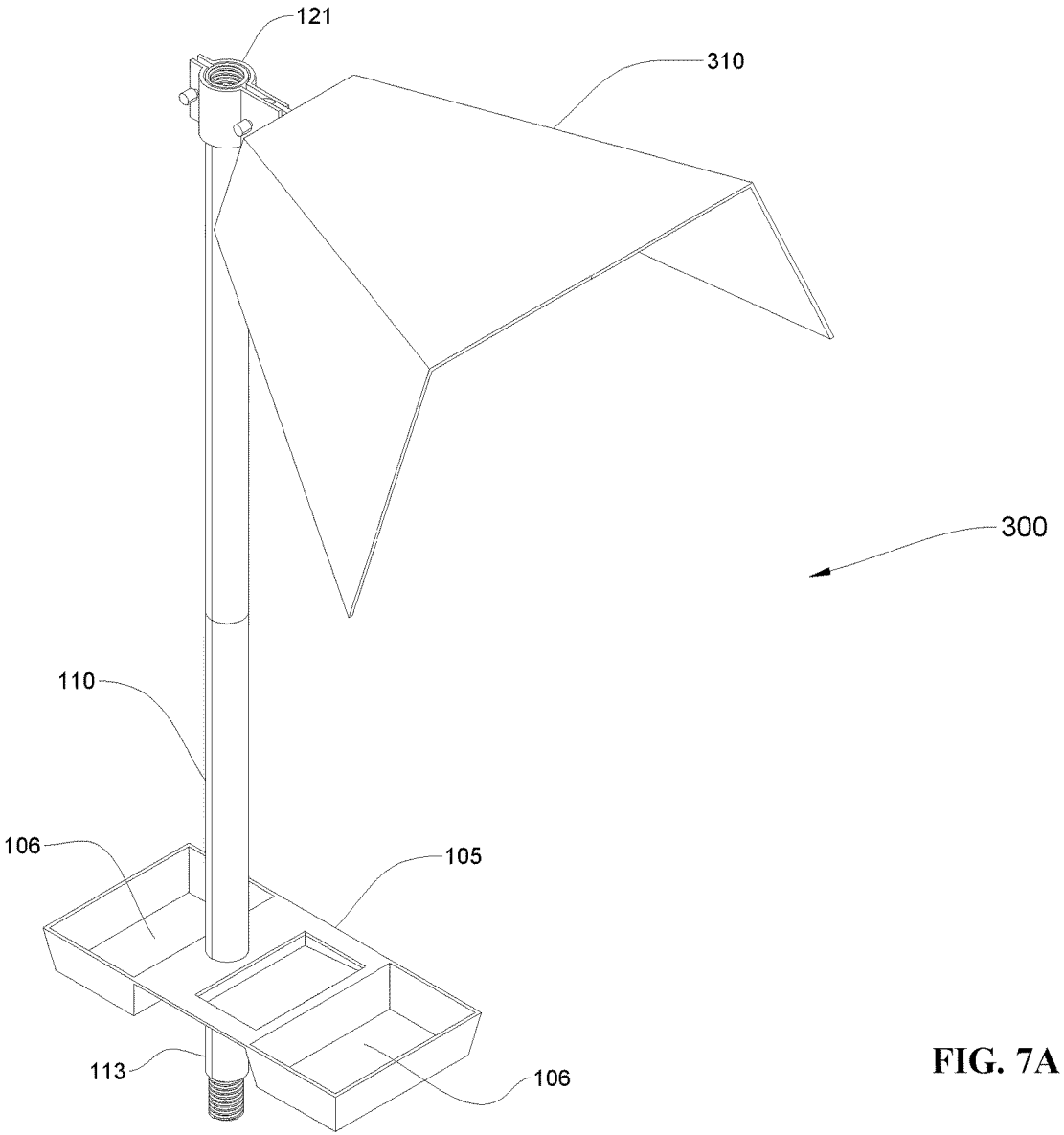
FIG. 7A is a top front side view of a mid-court light assembly according to the present disclosure.
Figure 7B:
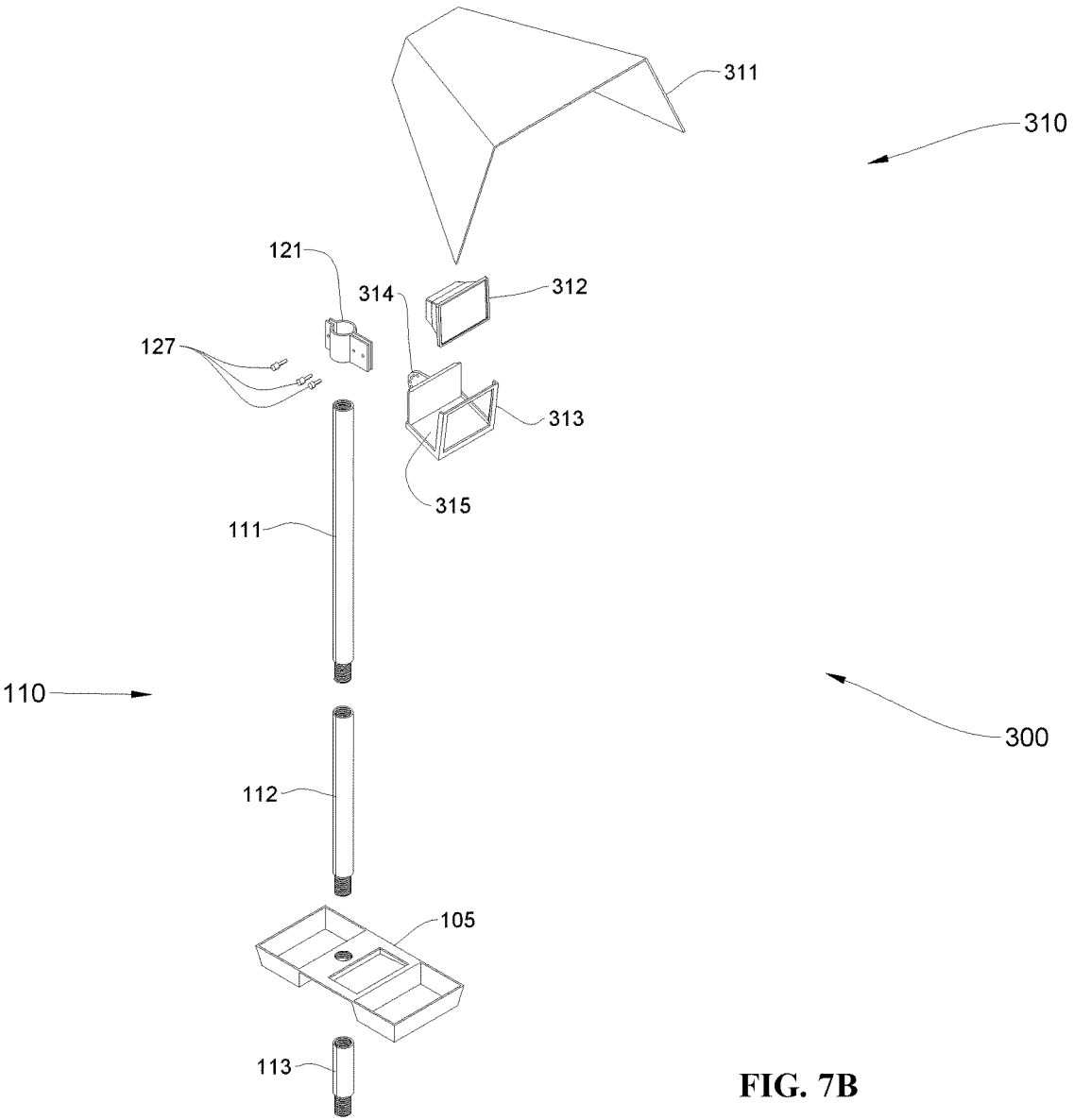
FIG. 7B is an exploded top front side view of the mid-court light assembly.

Referring now to FIGS. 7A and 7B, a mid-court assembly 300 is shown. As shown in FIGS. 4 and 5, four mid-court assemblies 300 are provided in a third embodiment, each mid-court assembly 300 being placed on a side of the volleyball court at a point halfway between a side center court assembly 200 and a corner assembly 100. Each mid-court assembly 300 is configured similarly to a corner assembly 100, but with a different light assembly (i.e., light fixture 310) mounted at a top end of vertical pole 110 and no lower light fixture mounted to base 105. Light fixture 310 is shown in expanded form in FIG. 7B and includes a hood 311, a light emitting element 312 and a bracket assembly 313. Bracket assembly 313 includes an adjustment mechanism 314 mounted on a rear portion thereof which provides an adjustable coupling to clamp mechanism 121. Light emitting element 312 slides into a front slot 315 of bracket assembly 313 and hood 311 slides down over bracket assembly 313 and is mated thereto in a conventional manner. Light emitting element 312 includes an integral high output light emitting element which is preferably battery-powered, but alternatively may be powered via a power cord that connects conventionally to an available electrical outlet.

Figure 8A:
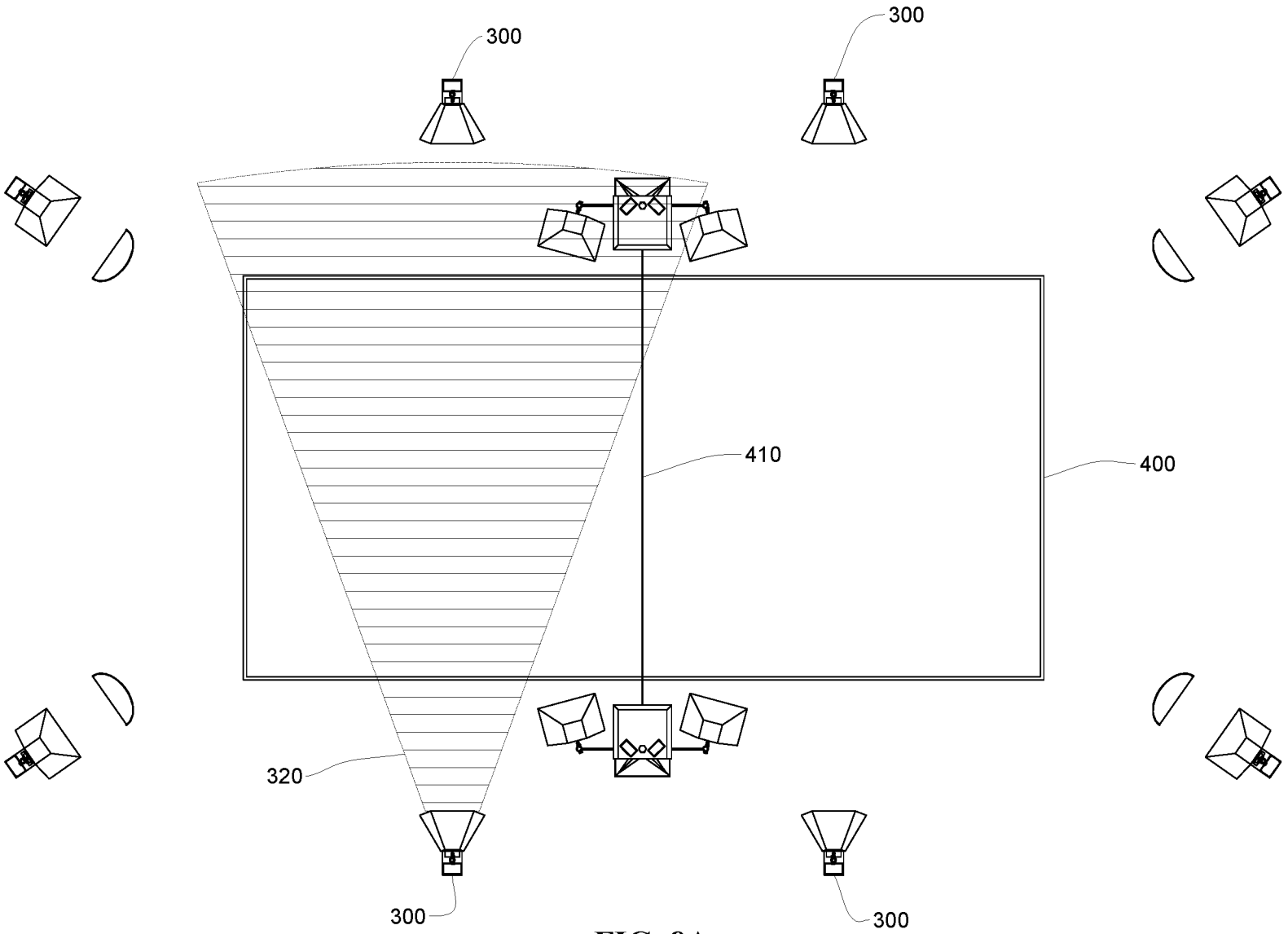
FIG. 8A is a top view of a volleyball court showing the light pattern dispersed from the light element on the mid-court light assembly.
Figure 8B:
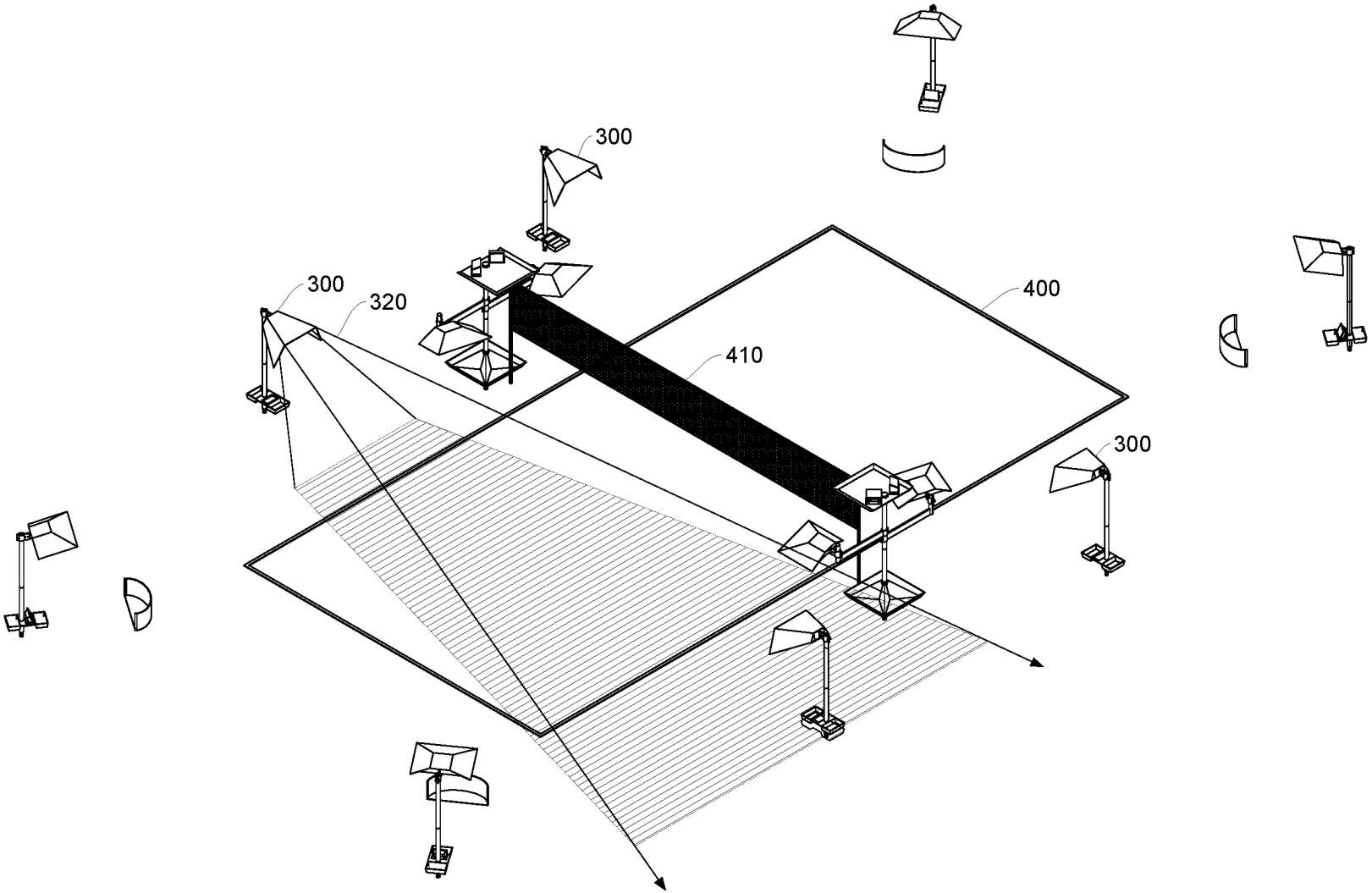
FIG. 8B is top front side view of a volleyball court showing the light pattern dispersed from the light element on the mid-court light assembly.

The adjustment mechanism 314 allows the hood 311 to rotate up and down in order to adjust how light emitted by light emitting element 312 is dispersed onto the volleyball court. In use, once a mid-court light assembly 300 is positioned as shown in FIGS. 4 and 5, the adjustment mechanism 314 is adjusted to so that light is emitted in a manner which illuminates the adjacent area of the volleyball court but at a level generally below the eye level of the volleyball players in order to eliminate glare. The light path 320 for one of the light emitting element 312 is shown in FIGS. 8A and 8B.

By adding four mid-court light assemblies 70, each positioned generally mid-way between a side center light assembly 200 and a corner light assembly 100, as shown in FIGS. 4 and 5, an additional amount of lighting will be provided on the sides of the volleyball court, without generating glare or shadows. This third embodiment is useful for high-level competition in night-time beach volleyball.

Figure 9:
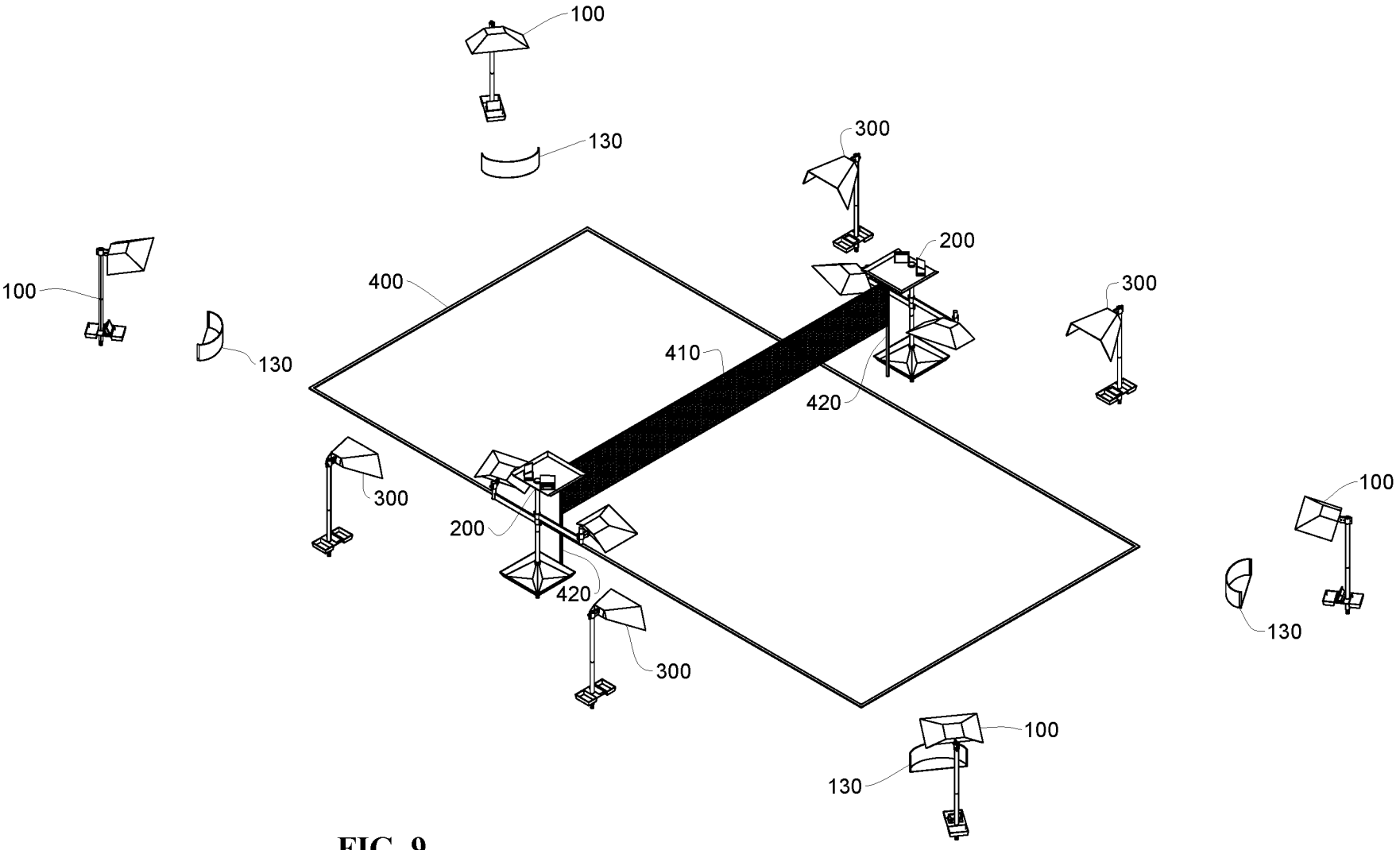
FIG. 9 is a top corner view of a volleyball court showing the position of the light assemblies according to embodiments of the present disclosure.
Figure 10:
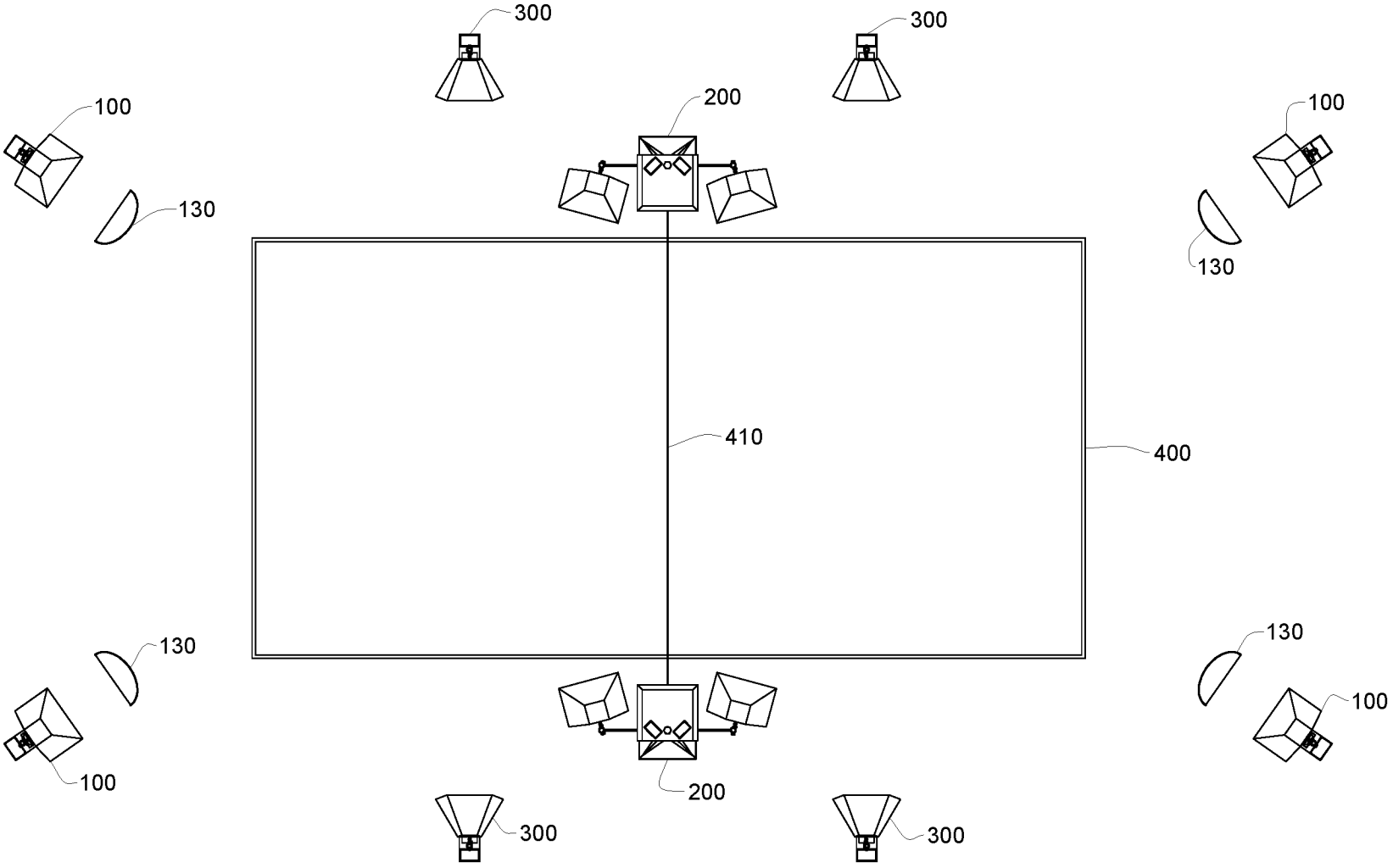
FIG. 10 is a top view of a volleyball court showing the position of the light assemblies according to embodiments of the present disclosure.

Referring now to FIGS. 9 and 10, the positioning of the various light assemblies is shown in relation to a volleyball court 400 having a net 410 at a center portion held up by two poles 420. In the first embodiment, only four corner light assemblies 100 are provided (along with associated glare protectors 130) at each corner of volleyball court 400. In the second embodiment, two side center light assemblies 200 are also provided, each adjacent to one of the poles 420. In the third embodiment, four mid-court light assemblies 300 are added, each positioned mid-way between a respective side center light assembly 200 and a corner light assembly 100.

Figure 11:
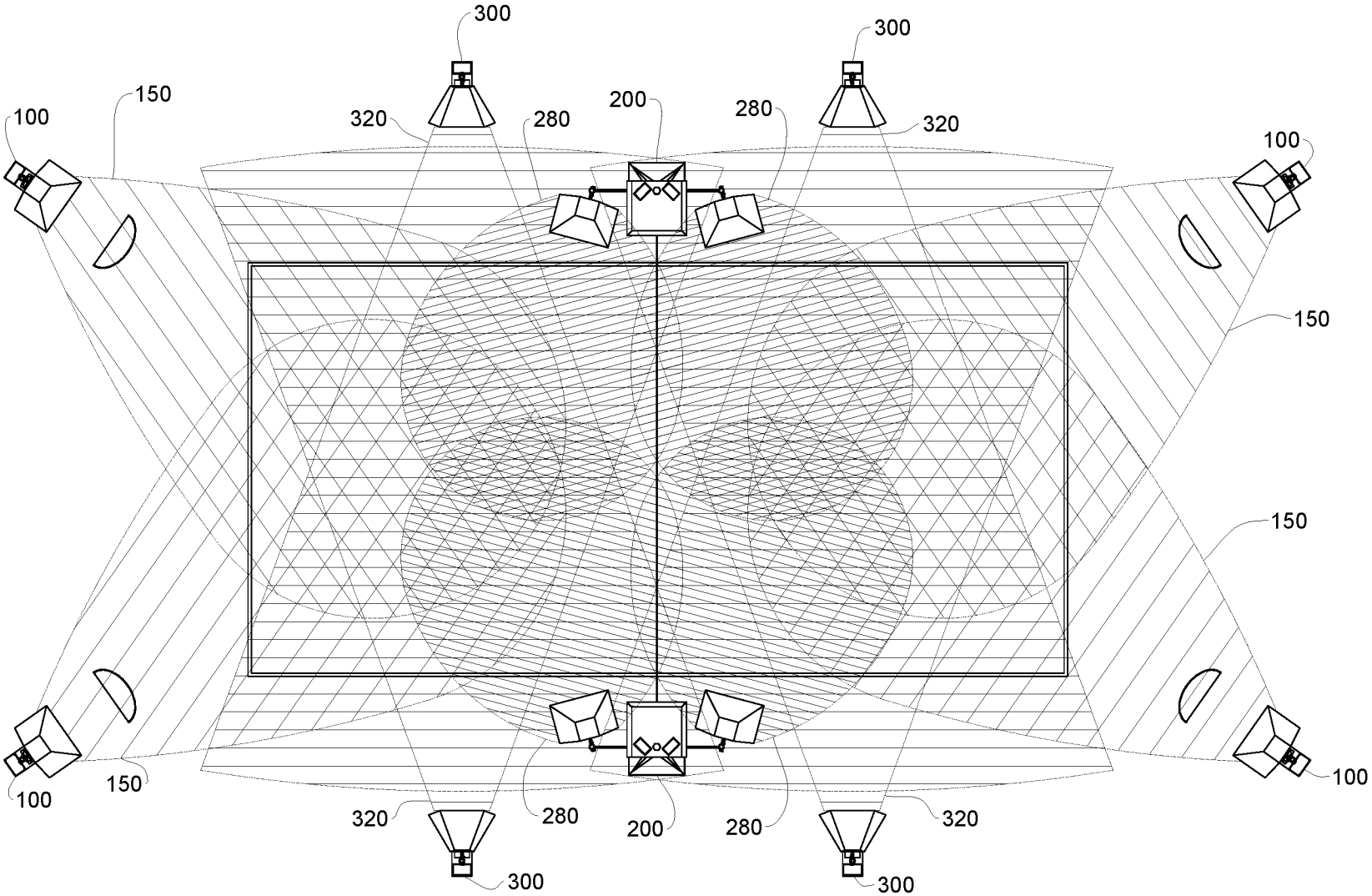
FIG. 11 is a top view of a volleyball court showing the light patterns dispersed from all the light emitting elements focused below the eye level of volleyball players on the volleyball court.
Figure 12:
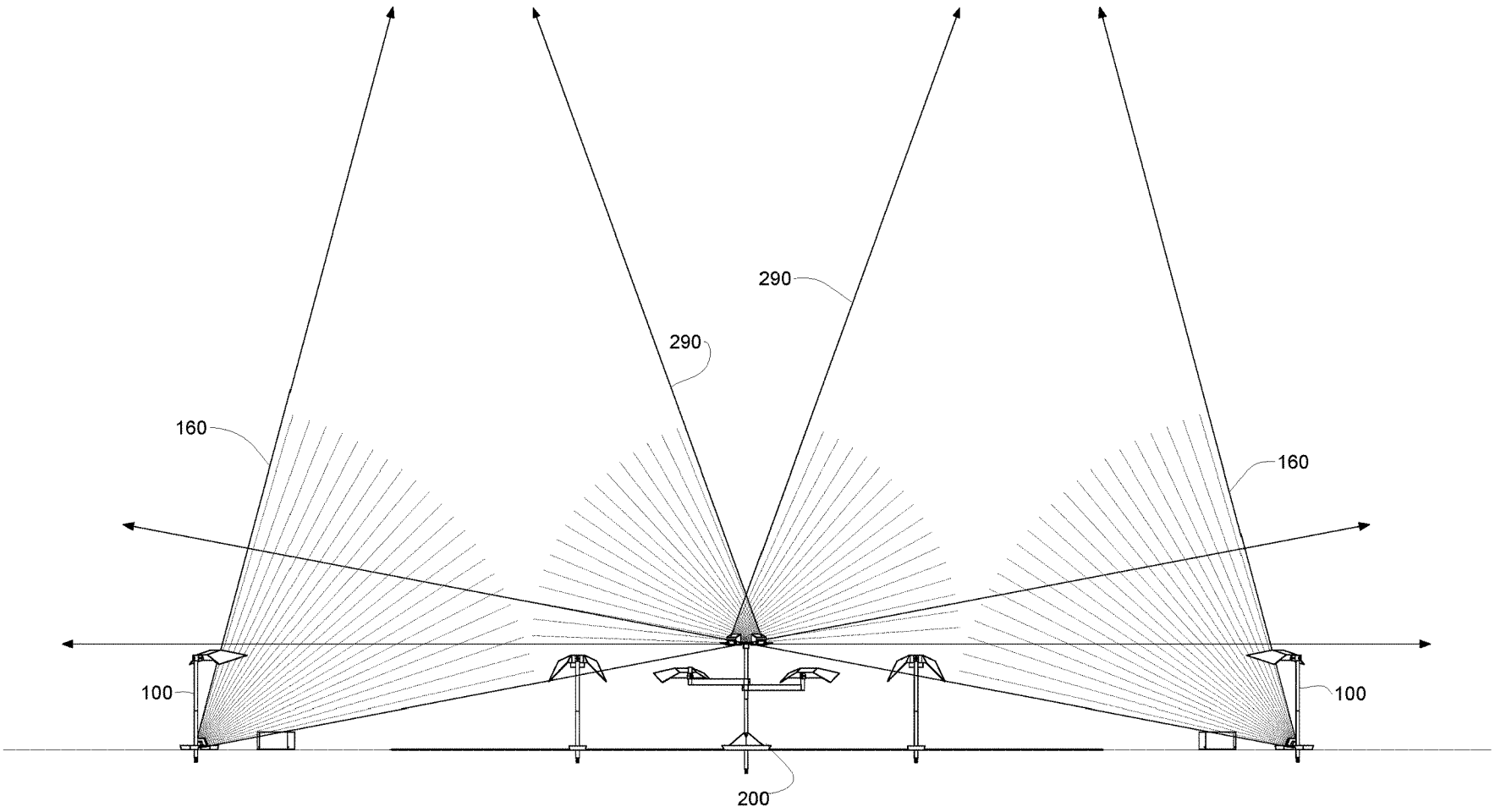
FIG. 12 is a side view of a volleyball court showing light patterns dispersed from light emitting elements in the center light assembly and the corner light assembly which are focused above the eye level of volleyball players on the volleyball court.
Figure 13:
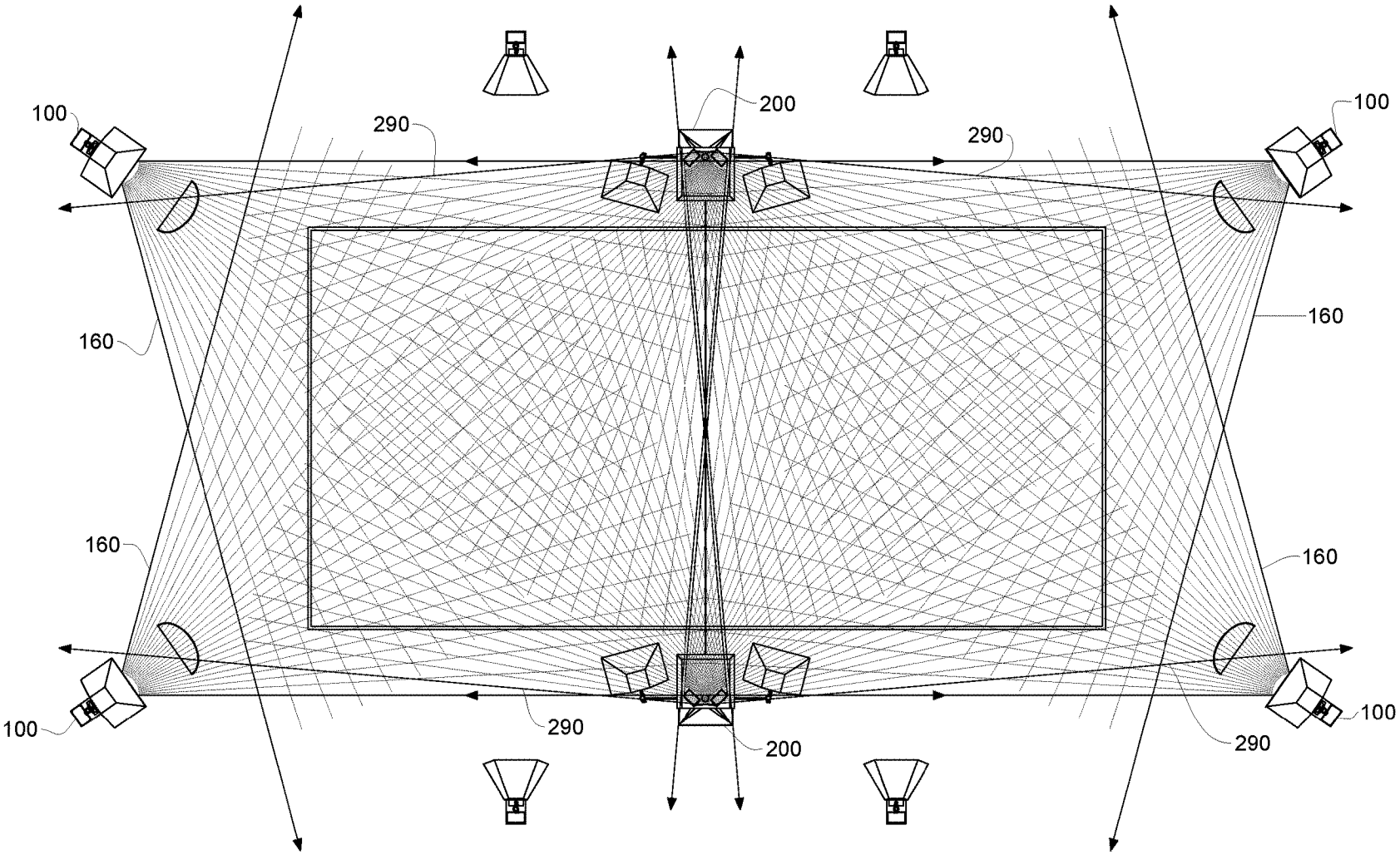
FIG. 13 is a top view of a volleyball court showing the light patterns dispersed from all the light emitting elements focused above the eye level of volleyball players on the volleyball court.

Referring now to FIG. 11, the below eye level light patterns 150, 280 and 360 from the three different types of light assemblies 100, 200, and 300, respectively, are shown overlaid upon each other in order to generate light over the entire volleyball court. Similarly, FIGS. 12 and 13 show how the above eye level light patterns 160 and 290, from the corner light assembly 100 and side center light assembly 200, respectively, are distributed in order to ensure that all areas above the eye level of a volleyball player on the volleyball court are lit up to ensure the ball is in view at all times during play.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A system for lighting a volleyball court comprising:

a plurality of first light assemblies for mounting around a perimeter of the volleyball court, each first light assembly comprising:

a base;

a first vertical pole fixedly coupled to the base at a first end thereof;

an upper light fixture coupled to the first vertical pole at a second end thereof, the second end opposite from the first end thereof, the upper light fixture adapted to emit light outward and downward at a level generally below an eye level of any player on the volleyball court; and a lower light element mounted in a slot on the base, the lower light element mounted in a manner to emit light outwards and upwards; and a plurality of second light assemblies for mounting around the perimeter of the volleyball court, each second light assembly comprising:

a second vertical pole;

two lower light fixtures coupled to the second vertical pole at a generally mid-point thereof via associated bracket arm assemblies, the two lower light fixtures adapted to emit light outward and downward at a level generally below an eye level of any player on the volleyball court; and an upper light assembly mounted to a top end of the second vertical pole, the upper light assembly adapted to emit light outwards and upwards at a level above the eye level of any player on the volleyball court.

2. The system of claim 1, wherein each lower light fixture in the second light assembly comprises:

a hood;

a light emitting element mounted in an interior portion of the hood; and an adjustment mechanism attached to the hood to allow the hood to rotate up and down with respect to the second vertical pole so that a vertical orientation of the hood with respect to the second vertical pole can be selected by a user to ensure that light is emitted from the light emitting element outward and downward at a level below an eye level of any player on the volleyball court.

3. The system of claim 2, wherein each lower light fixture in the second light assembly is coupled to the second vertical pole via a clamp mechanism clamped to a projecting member on the associated bracket arm assembly that is connected to the adjustment mechanism on the hood of the light fixture.

4. The system of claim 2, wherein each light emitting element in each lower light fixture of each second light assembly is battery-powered.

5. The system of claim 1, wherein the upper light fixture in the second light assembly comprises:

an upper platform coupled to the top end of the second vertical pole at a vertical height above the eye level of any player on the volleyball court; and two upper light modules each mounted in an associated slot in the upper platform, the slot positioned so that light from each upper light module is emitted upward and outwards across a portion of the upper platform, the upper platform thereby preventing any light from being dispersed below the vertical height of the upper platform.

6. The system of claim 5, wherein each upper light module in the upper light fixture in each second light assembly comprises:

a bracket; and a light emitting element mounted in an interior portion of the bracket.

7. The system of claim 6, wherein each light emitting element in each upper light module in each upper light fixture in each second light assembly is battery-powered.

8. The system of claim 1, further comprising:

a plurality of third light assemblies for mounting around the perimeter of the volleyball court, each third light assembly comprising:

a base;

a third vertical pole fixedly coupled to the base at a first end thereof; and a light fixture coupled to the third vertical pole at a second end thereof, the second end opposite from the first end thereof, the light fixture adapted to emit light outward and downward at a level generally below an eye level of any player on the volleyball court.

9. The system of claim 8, wherein the light fixture of each third light assembly comprises:

a hood;

a light emitting element mounted in a bracket assembly that couples to the hood; and an adjustment mechanism attached to the bracket assembly to allow the hood to rotate up and down with respect to the third vertical pole so that a vertical orientation of the hood with respect to the third vertical pole can be selected by a user to ensure that light is emitted from the light emitting element outward and downward at a level generally below an eye level of any player on the volleyball court.

10. The system of claim 9, wherein the light emitting element of the light fixture of each third light assembly is battery-powered.

11. The system of claim 9, wherein the light fixture of each third light assembly is coupled to the third vertical pole via a clamp mechanism clamped to the second end of the third vertical pole that is connected to the adjustment mechanism on the hood of the light fixture.

12. The system of claim 8, each third light assembly further comprising a below ground member coupled to a bottom side of the base to secure the base to a ground surface during use.

13. The system of claim 8, wherein the base of each third light assembly includes at least one cavity on a top surface thereof for containing material used to secure the base to a ground surface during use.

* * * * *